US010358191B2

(12) United States Patent
Vu

(10) Patent No.: US 10,358,191 B2
(45) Date of Patent: Jul. 23, 2019

(54) FLOATING STRUCTURE

(71) Applicant: Ensco International Incorporated, Wilmington, DE (US)

(72) Inventor: Van Van Vu, Houston, TX (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 15/208,858

(22) Filed: Jul. 13, 2016

(65) Prior Publication Data

US 2017/0015391 A1 Jan. 19, 2017

Related U.S. Application Data

(60) Provisional application No. 62/191,973, filed on Jul. 13, 2015.

(51) Int. Cl.

| | |
|---|---|
| ***E21B 19/00*** | (2006.01) |
| ***E21B 17/02*** | (2006.01) |
| ***E21B 17/04*** | (2006.01) |
| ***B63B 35/44*** | (2006.01) |
| ***B63B 1/10*** | (2006.01) |
| ***B63B 1/04*** | (2006.01) |
| ***B63B 39/00*** | (2006.01) |

(Continued)

(52) U.S. Cl.

CPC ..... *B63B 35/4413* (2013.01); *B63B 1/048* (2013.01); *B63B 1/107* (2013.01); *B63B 39/00* (2013.01); *B63B 2001/044* (2013.01); *B63B 2001/128* (2013.01); *B63B 2001/145* (2013.01)

(58) Field of Classification Search

CPC ..... E21B 33/076; E21B 7/128; E21B 19/006; E21B 17/01; E21B 19/08; E21B 19/22; E21B 19/16; E21B 19/18; E21B 33/0422

USPC ..... 166/351, 352, 355, 367, 77.1, 85.1, 166/75.14, 196, 224.2, 224.4

See application file for complete search history.

(56) References Cited

U.S. PATENT DOCUMENTS 3,986,471 A * 10/1976 Haselton ..... B63B 35/4413 114/265

4,114,393 A * 9/1978 Engle, Jr. ..... B63B 21/502 114/264

(Continued)

FOREIGN PATENT DOCUMENTS

| | | |
|---|---|---|
| EP | 0357269 | 3/1990 |
| WO | 2014181007 | 11/2014 |

OTHER PUBLICATIONS

Finn, "Buoyant Tower Offers New Platform for Shallow-water Field Development," Aug. 1, 2012, 4 pgs, PennWell Corporation, Tulsa, OK., http://www.offshore-mag.com/articles/print/volume-72/issue-8/engineering-construction-installation1/buoyant-tower-offers-new-platform-for-shallow-water-field-development.html.

(Continued)

*Primary Examiner* — Benjamin F Fiorello
*Assistant Examiner* — Edwin J Toledo-Duran
(74) *Attorney, Agent, or Firm* — Fletcher Yoder, P.C.

(57) ABSTRACT

Techniques and systems to reduce movement of at least one portion of an offshore platform. One portion of the offshore platform can provide a connection to a seafloor. A second portion of the offshore platform provides a lateral force to the first portion of the offshore platform while allowing for vertical movement between the first portion and the second portion of the offshore platform.

13 Claims, 8 Drawing Sheets

(51) Int. Cl.
*B63B 1/12* (2006.01)
*B63B 1/14* (2006.01)

(56) References Cited

U.S. PATENT DOCUMENTS 4,913,238 A * 4/1990 Danazcko ..... B63B 21/502 166/350
5,135,327 A * 8/1992 White ..... E21B 7/128 114/265
5,439,321 A * 8/1995 Hunter ..... B63B 21/502 166/350
6,190,089 B1 * 2/2001 Bennett, Jr. ..... B63B 35/4406 114/256
6,206,614 B1 * 3/2001 Blevins ..... B63B 35/4413 114/264
6,257,165 B1 7/2001 Danos, Jr. et al.
6,263,824 B1 7/2001 Balint et al.
6,343,893 B1 * 2/2002 Gleditsch ..... E21B 19/002 114/264
6,470,969 B1 * 10/2002 Sorhaug ..... E21B 19/006 166/352
6,786,679 B2 9/2004 Huang et al.
7,556,452 B2 7/2009 O'Sullivan
8,267,032 B2 * 9/2012 Zou ..... B63B 35/4413 114/266
8,540,460 B2 * 9/2013 Pallini ..... B63B 35/44 405/224.4
8,613,322 B2 12/2013 Coles
8,764,346 B1 * 7/2014 Srinivasan ..... B63B 21/502 405/223.1
9,074,446 B2 * 7/2015 Kristensen ..... E21B 19/006
2004/0253059 A1 12/2004 Horton, III
2005/0013666 A1 1/2005 Chianis et al.
2008/0203734 A1 * 8/2008 Grimes ..... E21B 3/02 290/40 R
2011/0005443 A1 1/2011 Caracostis et al.
2011/0206466 A1 8/2011 Rawles, II et al.
2012/0263543 A1 10/2012 Lee
2014/0174753 A1 * 6/2014 Kristensen ..... E21B 19/006 166/350
2015/0000583 A1 1/2015 Betran Palomas et al.
2015/0298775 A1 10/2015 Muehlner et al.

OTHER PUBLICATIONS

Barton, "Deepwater Floating Facilities—an Overview," 2014, 8 pgs, http://oilpro.com/post/636/deepwater-floating-facilities—an-overview.
Application No. PCT/US2016/042138 International Search Report and Written Opinion dated Oct. 18, 2016, pp. 16.

* cited by examiner

FLOATING STRUCTURE

CROSS REFERENCE TO RELATED APPLICATIONS

This application is a Non-Provisional application of U.S. Provisional Patent Application No. 62/191,973, entitled "Floating Structure" filed Jul. 13, 2015, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. However, offshore drilling and production facilities (e.g., offshore platforms) may encounter problems not found with land based drilling and production facilities.

For example, when operating in water, lateral positioning techniques and systems (e.g., thrusters or similar devices) may be utilized to counteract lateral movement caused by currents, waves, and the like. Additionally, stability of the offshore platforms is to be maintained. One technique for maintaining the stability of an offshore platform is to design the platform to have a sufficient waterplane area (e.g., an enclosed area of the facility hull at the waterline) to allow for stability of the offshore platform. However, while increasing the waterplane area of an offshore platform may increase its stability (e.g., its ability to resist sway (lateral/side-to-side motion) and surge (longitudinal/front-and-back motion) imparted by maritime conditions), increasing the waterplane area of the offshore platform may also increase its susceptibility to heave (e.g., vertical/up-and-down motion).

DETAILED DESCRIPTION

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Systems and techniques for stabilizing an offshore platform, such as a semi-submersible platform, a drillship, a spar platform, a floating production system, or the like, are set forth below. In one embodiment, the offshore platform may include a first (e.g., outer) platform that provides stability for the offshore platform (e.g., resists sway and surge). The offshore platform may also include a second (e.g., inner) platform that resists heave. The first platform may operate to provide a lateral support to the second platform with little or no vertical support of the second platform. For example, one or more lateral supports may be disposed between the first and platform and the second platform to provide the lateral support to the second platform.

In some embodiments, the second platform may be coupled to a submerged buoyant base by one or more supports. In some embodiments, the one or more supports may be releasable from the buoyant base, for example, to allow the offshore platform to move from one buoyant base to another. Additionally, in some embodiments, the offshore platform may include one or more apertures that may be covered or exposed to vary a waterplane area of the offshore platform. In this manner, the offshore platform may allow for alternate adjustment of its waterplane area, for example, during different use operations.

Figure 1:
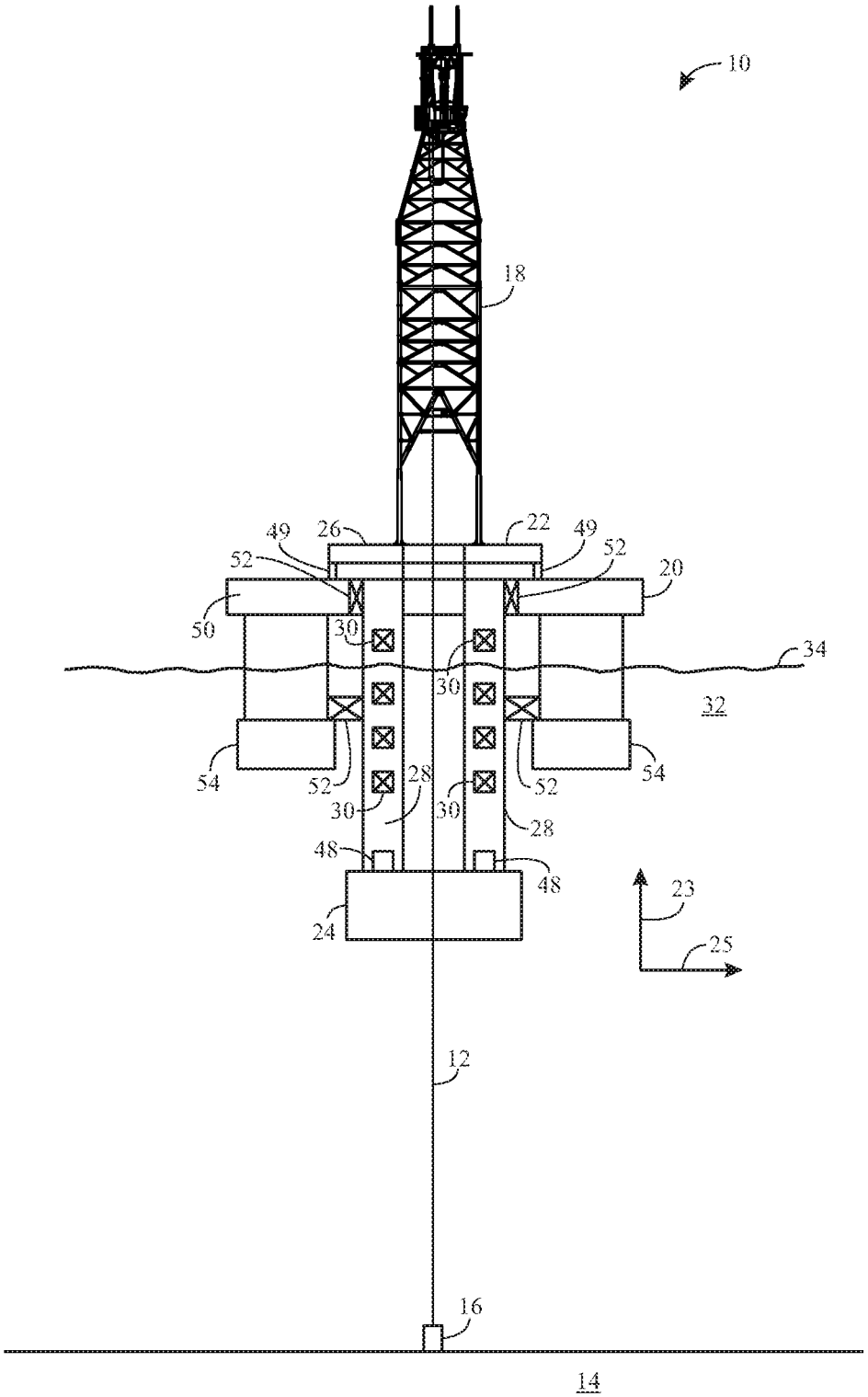
FIG. 1 illustrates an example of an offshore platform, in accordance with an embodiment.

With the foregoing in mind, FIG. 1 illustrates an offshore platform 10 comprising a semi-submersible platform. Although the presently illustrated embodiment of an offshore platform 10 is a semi-submersible platform (e.g., a moveable platform equipped with a drill rig and engaged in offshore oil and gas exploration and/or well maintenance or completion work including, but not limited to, casing and tubing installation, subsea tree installations, and well capping), other offshore platforms such as a drillship, a spar platform, a floating production system, or the like may be substituted for the platform 10. Indeed, while the techniques and systems described below are described in conjunction with platform 10, the stabilization techniques and systems are intended to cover at least the additional offshore platforms described above.

As illustrated in FIG. 1, the platform 10 includes a riser 12 extending therefrom. The riser 12 may include a pipe or a series of pipes that connect the platform 10 to the seafloor 14 at a wellhead 16 on the seafloor 14. In some embodiments, the riser 12 may transport produced hydrocarbons and/or production materials between the platform 10 and the wellhead 16. Additionally, the riser 12 may pass through an opening (e.g., a moonpool) in the platform 10 and may be coupled to drilling equipment 18 of the platform 10. As illustrated in FIG. 1, it may be desirable to have the riser 12 positioned in a vertical orientation between the wellhead 16 and the platform 10. However, external factors (e.g., environmental factors such as currents, waves, and the like) may disturb the vertical positioning of the platform 12.

Accordingly, the platform 10 may include a stability platform 20 and an inner platform 22. In one embodiment, the stability platform 20 may provide a sufficient waterplane area to maintain the stability of the platform 10. Similarly, the inner platform 22 may operate to provide tension for the riser 12 and may operate to reduce and/or eliminate movement of the inner platform 22 in a vertical direction 23 relative to the seafloor 14. Accordingly, for example, the inner platform 22 may provide sufficient upward force to the riser to prevent buckling of the riser 12 while also preventing stretch (e.g., vertical expansion) of the riser 12. In some embodiments, the inner platform 22 may include a submerged buoyant base 24 coupled to an upper plate 26 by one or more supports 28. These supports 28 may include one or more apertures 30 that allow water 32 to pass through the supports 28 so as to reduce the waterplane area of the supports 28. In this manner, the inner platform 22 may be utilized below a waterline 34 with minimal impact to the overall waterplane area of the platform 10. Additionally, the one or more apertures 30 may be alternately covered or exposed to vary a waterplane area of the offshore platform 10. In this manner, the offshore platform may allow for alternate adjustment of its waterplane area, for example, during different use operations. Additionally or alternatively, one or more pontoons may also be utilized to vary the waterplane area of the offshore platform 10 by, for example, affixing the pontoons to the supports 28 and/or to the stability platform 20. Additionally or alternatively, the apertures 30 may also be present on the stability platform 20 to further vary the waterplane area of the offshore platform 10. In this manner, the waterplane area of the platform 10 may be able to be modified.

Furthermore, the buoyant base 24 may operate to provide an upward force sufficient to, for example, support drilling equipment 18 (or any equipment, such as production equipment, on upper plate 26) as well as prevent buckling and/or stretch of the riser 12. In this manner, the platform 10 may operate without the use of a riser tensioning system that would traditionally manage and mitigate vertical movements of the riser 12. In some embodiments, the buoyant base 24 may be a foam material or other buoyant material that is selected with particular size and density characteristics chosen to provide a known about of force in a vertical direction 23 away from the seafloor 14. In some embodiments, the buoyant base 24 may be spaced about but not in contact with the riser 12 to allow for freedom of movement of the riser. However, other embodiments, the buoyant base 24 may contact riser 12 (e.g., in situations when supports 28 are to be separated from buoyant base 24 to allow the platform 10 to move from its location above wellhead 16). Additionally, the buoyant base 24 may be actively or passively controlled to alter the buoyancy characteristics of the buoyant base 24 and, thus, the amount of upward force provided by the buoyant base 24.

Figure 2:
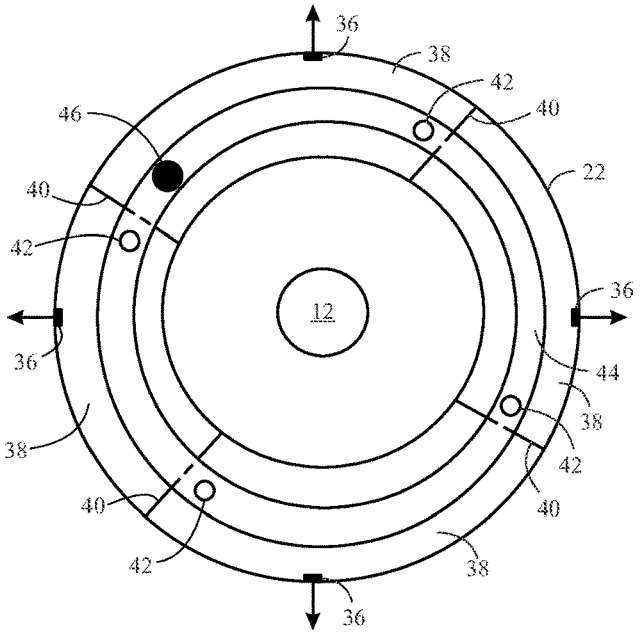
FIG. 2 illustrates a top view of a portion of a buoyant base of the offshore platform of FIG. 1, in accordance with an embodiment.

FIG. 2 illustrates a top view of an embodiment of the buoyant base 24 that allows for adjustment of the buoyancy of the buoyant base 24. Buoyant base 24 may include outlets 36 that are positioned, for example, every 90 degrees around a circumference of the buoyant base 24. In one embodiment, separate plenum chambers 38 (fluidly separated from one another by barriers 40) may be present in the buoyant base 24 or a single plenum chamber may instead be utilized. These plenum chambers 38 may receive high pressure fluid (or, for example, seawater) via one or more valves 42 in a high pressure plenum 44. In some embodiments, high pressure plenum 44 may be circumferentially disposed above the plenum chambers 38, and the high pressure plenum 44 may be coupled to a hose via aperture 46 whereby the hose may, for example, extend from and receive seawater or high pressure fluid from drilling equipment 18. The operation of the valves 42 may be controlled, for example, by a controller of the buoyant base 24 and/or by a control system of the platform 10 to allow for the high pressure fluid to be transmitted into a particular plenum chamber 38 for venting of the fluid via respective outlet 36. In other embodiments, the valves may be hydraulically actuated, acoustically actuated, pressure actuated, electrically actuated, or similarly actuated.

In some embodiments, additional valves in the plenum chambers 38 may control the amount of fluid transmitted from the outlets 36, for example, in response to detected current conditions and/or based on historical data such that operation of the separate outlets 36 may be controllable to mitigate changing currents (e.g., based on time of day, season, etc.). The operation of the valves 42 that control the amount of fluid transmitted from the outlets 36 may be controlled, for example, by a controller of the buoyant base 24 and/or by a control system of the platform 10. In other embodiments, the valves may be hydraulically actuated, acoustically actuated, pressure actuated, electrically actuated, or similarly actuated. Control of the valves of the buoyant base 24 may ensure that proper upward force of the inner platform 22 as provided by the buoyant base 24 remain within tolerance levels.

Furthermore, with respect to the outlets 36, it is envisioned that multiple outlets 36 may exist in each plenum chamber 38. For example, multiple outlets 36 may be arranged vertically along the plenum chamber 38 and may extend along a length of the plenum chamber 38. Alternatively, one outlet 36 (e.g., disposed as a slit or other aperture) may extend vertically along the plenum chamber 38 and may extend along a length of the plenum chamber 38. It is envisioned that the number, size, arrangement, and distance that the one or more outlets 36 occupy may be, for example, a function of the surface area of the buoyant base 24 and the desired strength of the flow exiting the buoyant base 24.

Returning to FIG. 1, the buoyant base 24 may be welded or otherwise affixed to the one or more supports 28. Alternatively, the buoyant base 24 may be separable from the one or more supports 28. In this manner, the platform 10 may separate from the buoyant base 24 to move to a second buoyant base 24 for subsequent attachment thereto. One or more fasteners 48 may be utilized to couple the buoyant base 24 to each of the one or more supports 28. The fasteners 48 may include a fastener or locking mechanism, for example, a latch, pin, bolt, or the like. In one embodiment, fastening and releasing of the buoyant base 24 to and from supports 28 may be accomplished below the waterline 34, for example, by a Remotely Operated Vehicles (ROV). An ROV may be a remotely controllable robot/submersible vessel with that may be controlled from the platform 10. The ROV may use a fastener or locking mechanism to couple the buoyant base 24 to the one or more supports 28. Alternatively, the fastener or locking mechanism may automatically engage as the ROV applies pressure to at least one side of the buoyant base 24 or the one or more supports 28 to form a coupled connection. Additionally, the ROV may be utilized to couple the buoyant base 24 to the riser 12 (e.g., for situations when supports 28 are to be separated from buoyant base 24 to allow the platform 10 to move from its location above wellhead 16).

As illustrated, platform 10 may also include posts 49. The posts 49 may be placed between the upper plate 26 and deck 50 of the stability platform 20 and may include one or more shock absorbers (e.g., coils/springs or the like) to cushion any movement between the upper plate 26 and deck 50 of the stability platform 20. Additionally, the posts 49 may operate to support the weight of the upper plate 26 and any equipment thereon without any aid from buoyant base 24.

As previously discussed, the buoyant base 24 may operate to resist heave of the inner platform 22. However, because of the small waterplane area of the inner platform 22, the inner platform 22 may be susceptible to instabilities (e.g., susceptible to sway and surge). Accordingly, the stability platform 20 may provide a lateral force (in a horizontal direction 25 relative to the seafloor 14) to the inner platform 22 while allowing for vertical movement of the stability platform 20 with respect to the inner platform 22. In this manner, the inner platform 22 may maintain a fixed distance with respect to seafloor 14 while the stability platform 20 moves in a vertical direction 23 with respect to the seafloor 14 due to, for example, marine conditions causing heave. To facilitate this movement between the stability platform 20 and the inner platform 22, one or more lateral supports 52 may be utilized, for example, adjacent deck 50 of the platform 10.

Figure 3:
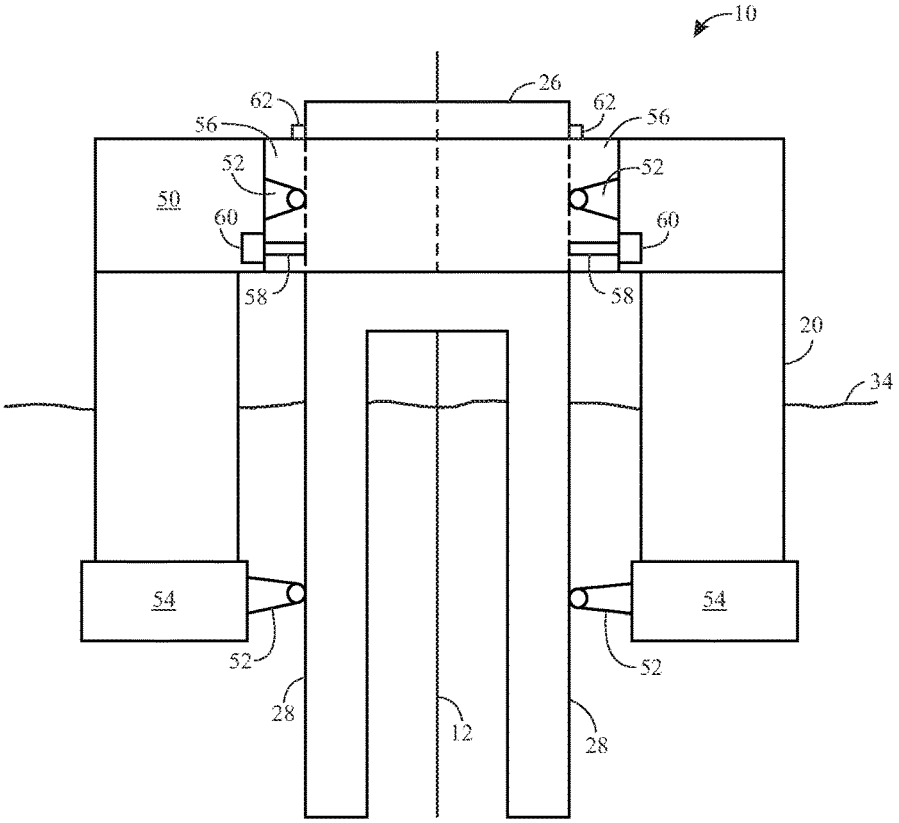
FIG. 3 illustrates a side view of a portion of the offshore platform of FIG. 1, in accordance with an embodiment.

FIG. 3 illustrates an embodiment of the platform 10 that includes the stability platform 20 and the inner platform 22 as well as lateral supports 52 disposed therebetween. In the illustrated embodiment, upper plate 26 may be disposed below, for example, the drill floor of the platform 10 such that the drilling equipment 18 (or production equipment) is positioned on the stability platform 20. However, it should be appreciated that the drilling equipment 18 (or production equipment) may instead be positioned on the upper plate 26, as illustrated in FIG. 1.

As illustrated, one or more lateral supports 52 may be disposed about the inner platform 22. These lateral supports 52 may, for example, allow the stability platform 20 to glide or float with the motion of the water 32 while still providing lateral support (e.g., a force in a horizontal direction 25 relative to the seafloor 14) to the inner platform 22. The resulting reaction force of each of the one or more lateral supports 52 is a force that is perpendicular to, and away from, the surface of the lateral support 52. The lateral supports 52 may be, for example, pads 15 that may be made of Teflon-graphite material or another low-friction material (e.g., a composite material) that allows for motion of the stability platform 20 in a vertical direction 25 relative to the seafloor 14 with reduced friction characteristics. In addition to, or in place of the aforementioned pads, other lateral supports 52 including bearing or roller type supports (e.g., steel or other metallic or composite rollers and/or bearings) may be utilized. It should also be noted that while lateral supports 52 are illustrated as being disposed along deck 50 of the platform 10 as well as along pontoons 54 of the stability platform 20, alternate and/or additional locations of the lateral supports 52 are contemplated.

The lateral supports 52 may be disposed about an aperture 56 and may each engage the inner platform 22. In some embodiments, the lateral supports 52 may be disposed equivalently about the inner platform 22. For example, if two lateral supports 52 are utilized, the lateral supports 52 may be disposed approximately 180 degrees from one another. Likewise, if three, four, five, six, or eight lateral supports 52 are utilized, the lateral supports 52 may be disposed approximately 120 degrees, 90 degrees, 72 degrees, 60 degrees, and 45 degrees, respectively, from one another. Additionally, the inner platform 22 may be cylindrical in shape or may be multi-sided in shape structure (e.g., rectangular, hexagonal, octagonal, etc.). In some embodiments, there may be one lateral support 52 to correspond to each distinct side of a multi-sided shaped inner platform 22.

FIG. 3 also illustrates braking elements 58. Braking elements 58 may operate to slow the relative movement between the stability platform 20 and the inner platform 22. For example, if the one or more supports 28 are decoupled from the buoyant base 24 and/or if the riser 12 is decoupled from the wellhead 16, accelerated movement between the stability platform 20 and the inner platform 22 may occur. To aid in the controlled movement during these situations, braking elements 58 (e.g., frictional pads or the like) may be applied to the inner platform 22 via, for example, actuators 60 (which may be hydraulically or electrically controlled, for example, by a controller of the platform 10). Additionally, as illustrated in FIG. 3, one or more fasteners 62 may be utilized to couple the inner platform 22 to the stability platform 20. The fasteners 62 may include a fastener or locking mechanism, for example, a latch, pin, bolt, or the like. The fasteners 62 may be utilized to secure the inner platform 22 to the stability platform 20, for example, as the platform 10 is moving from one location to another to prevent movement between the stability platform 20 and the inner platform 22.

Figure 4:
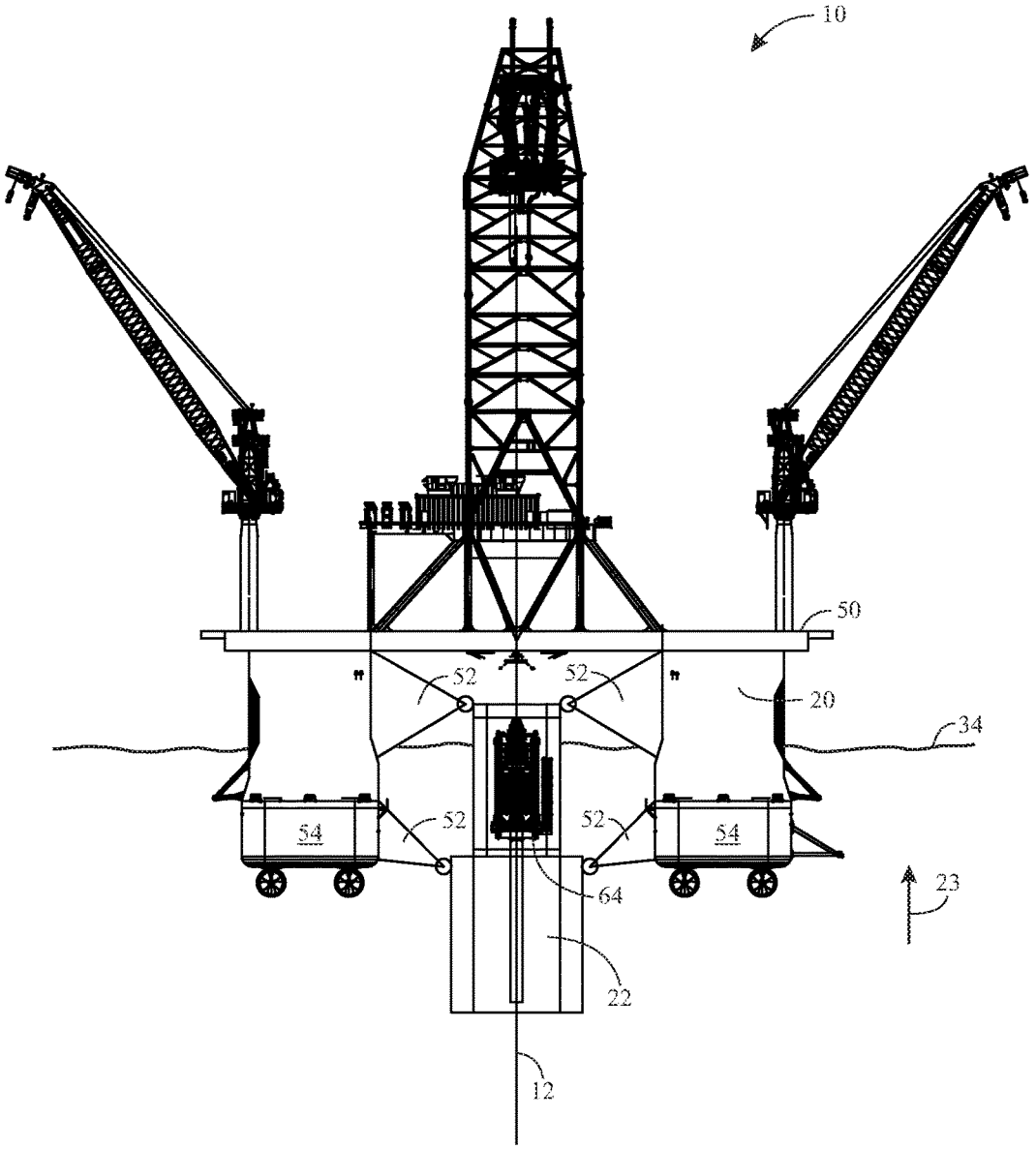
FIG. 4 illustrates an example of the offshore platform of FIG. 1 experiencing maritime conditions at a first time, in accordance with an embodiment.

FIG. 4 illustrates offshore platform 10 experiencing maritime conditions at a first time, such as when a crest (topmost portion) of a wave of waterline 34 causes movement of the stability platform 20 in a vertical direction 23 relative to the seafloor 14 (e.g., away from the seafloor 14). This has an effect of lowering the relative position of the inner platform 22 with respect to the stability platform 20. As illustrated, the offshore platform 10 may operate with a blowout preventer (BOP) 64 that is not a subsea BOP (e.g., that not coupled to the wellhead 16 on the seafloor 14). Instead, the BOP 64 may be placed proximate to the offshore platform 10, e.g., along or near the waterline 34. This may allow for ease of access to the BOP 64 (e.g., to allow for maintenance, servicing, or the like) relative to a deep sea BOP which, in turn, may substantially reduce downtime (e.g., non-operational time) for the offshore platform 10.

As illustrated in FIG. 4, the BOP 64 may be disposed in and coupled to the inner platform 22, such that the BOP 64 does not move relative to seafloor 14 as the stability platform 20 moves in a vertical direction 23 away from the seafloor 14 due to, for example, a crest of a wave of waterline 34 by inner platform 22. In this manner, the inner platform 22 may house the BOP 64. For example, one or more walls 66 may partially (e.g., circumferentially) enclose the BOP 64 to prevent waves of waterline 34 from impacting the BOP 64. However, because the walls 66 are not fully sealed (e.g., openings above and/or below the BOP 64 in the inner platform 22 may be present), the waterplane area of the platform 10 may be minimally affected.

Figure 5:
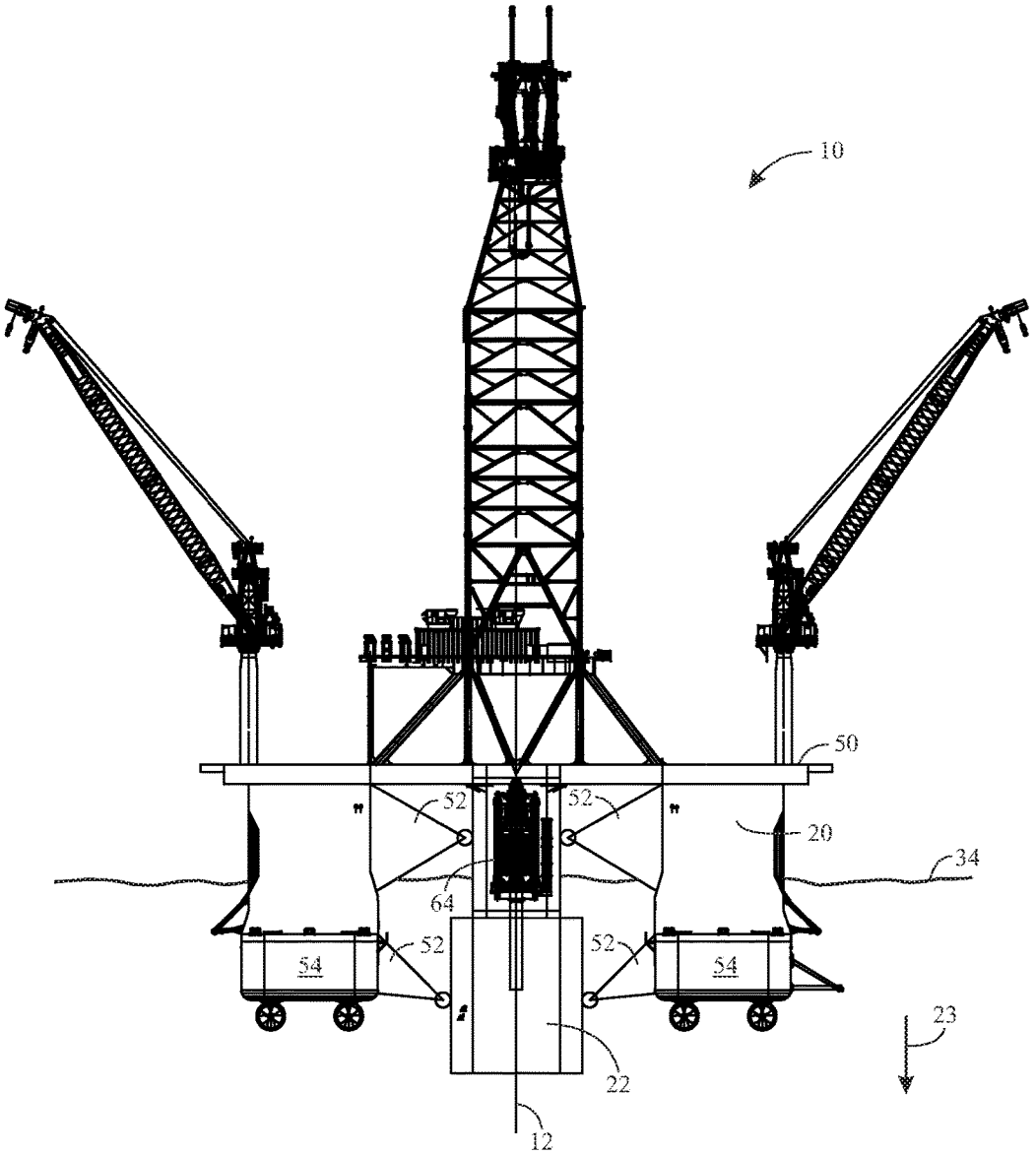
FIG. 5 illustrates an example of the offshore platform of FIG. 1 experiencing maritime conditions at a second time, in accordance with an embodiment.
Figure 6:
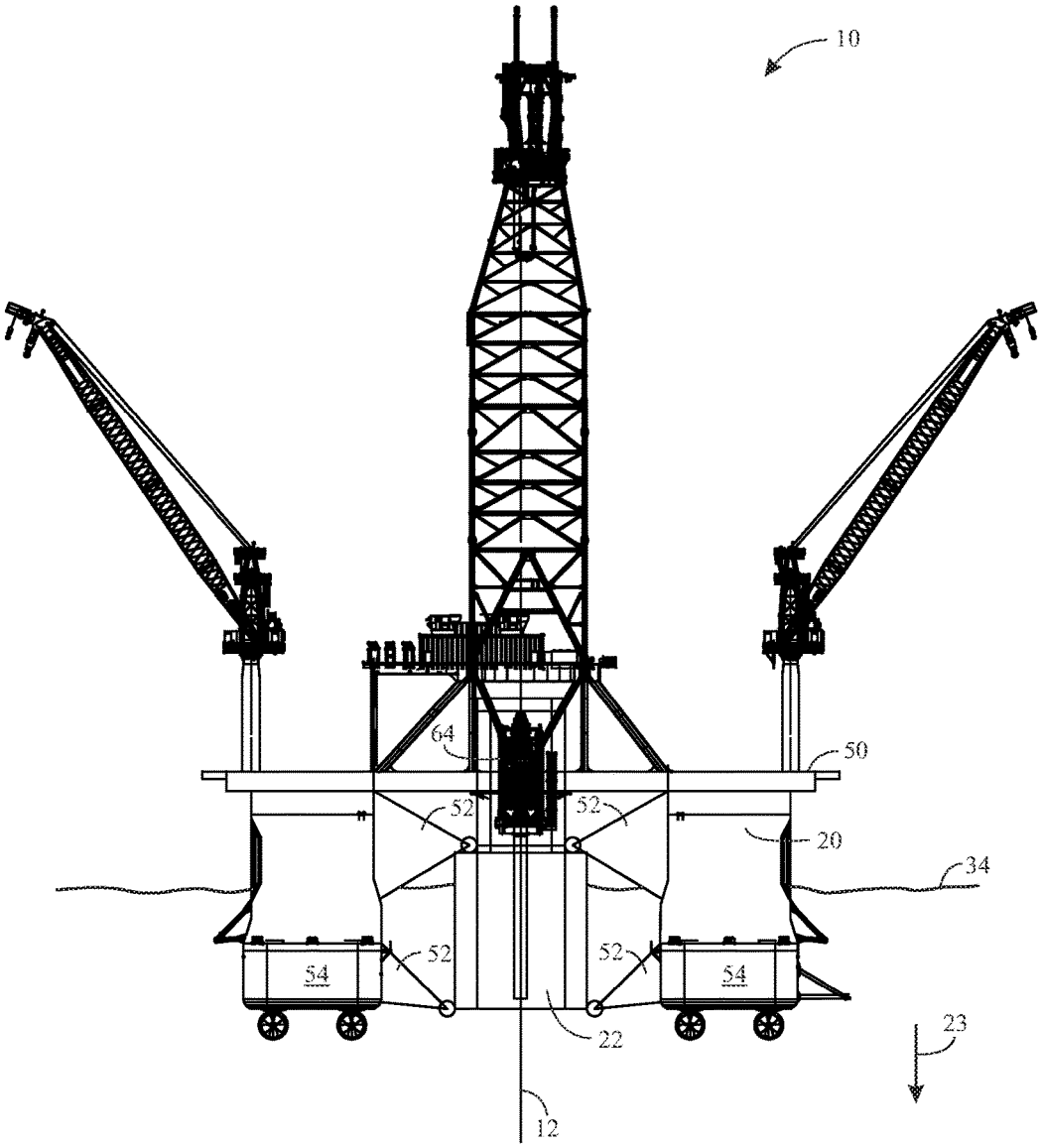
FIG. 6 illustrates an example of the offshore platform of FIG. 1 experiencing maritime conditions at a third time, in accordance with an embodiment.

Similarly, as illustrated in FIG. 5, offshore platform 10 may experience a maritime condition at a second time, such as when a the midpoint of the amplitude of a wave of waterline 34 causes a centering of a relative position of the inner platform 22 with respect to the stability platform 20. Likewise, FIG. 6 illustrates offshore platform 10 experiencing maritime conditions at a third time, such as when a trough of a wave of waterline 34 causes movement of the stability platform 20 in a vertical direction 23 relative to the seafloor 14 (e.g., towards the seafloor 14). This has an effect of raising the relative position of the inner platform 22 with respect to the stability platform 20. However, as previously discussed, even as the stability platform 20 moves in a vertical direction 23 with respect to the seafloor 14, the inner platform 22 remains relatively unchanged in its distance from seafloor 14. In this manner, because of the relative fixed vertical positioning of the inner platform 22, a BOP 64 that is a non-subsea BOP may be utilized in place of a subsea BOP. However, it is noted that a subsea BOP can be utilized in conjunction with the offshore platform 10 when desirable. In this instance, the BOP will be placed adjacent wellhead 16 and the inner platform 22 and stability platform 20 may continue to operate as discussed above.

Figure 7:
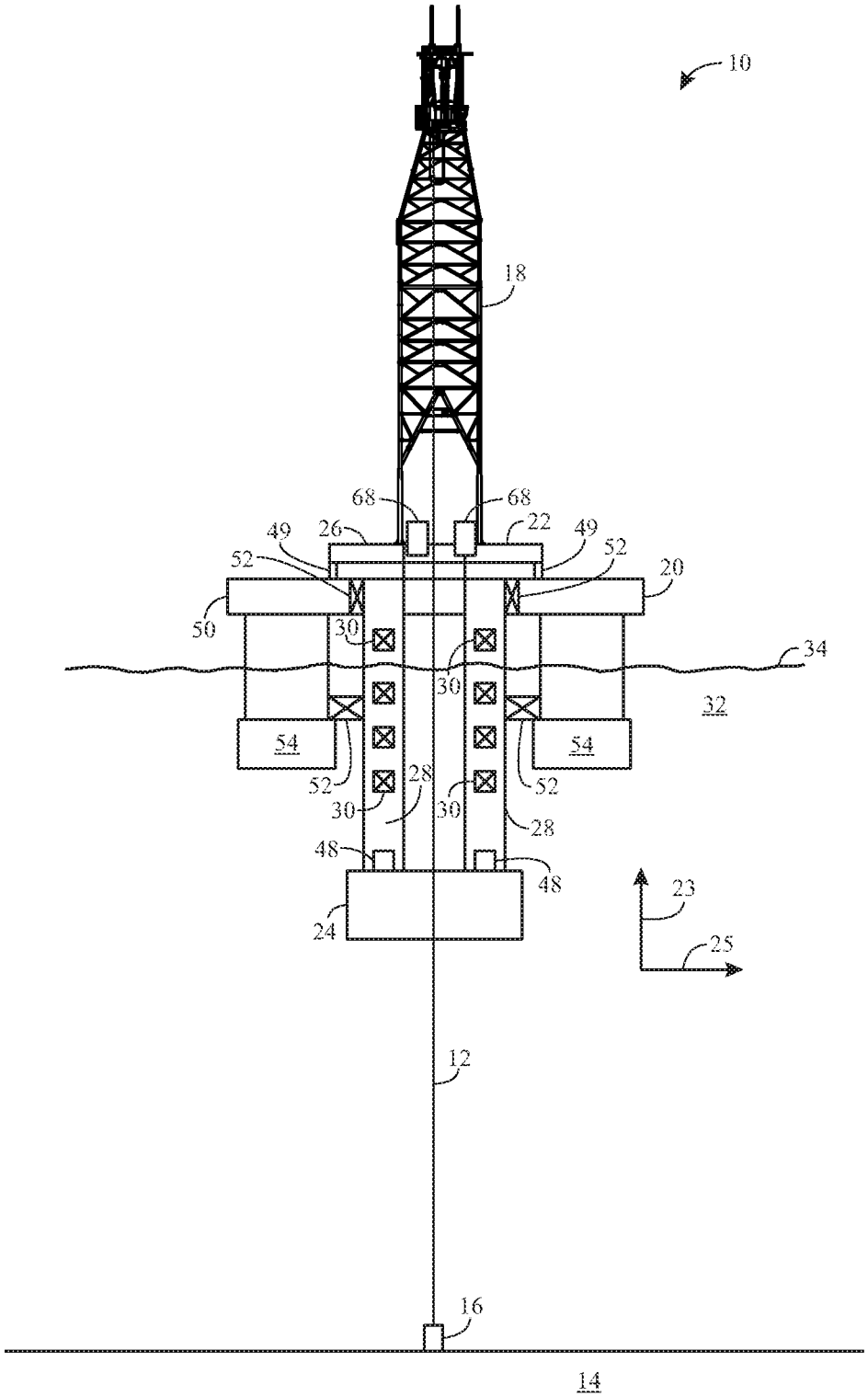
FIG. 7 illustrates a second example of an offshore platform, in accordance with an embodiment.
Figure 8:
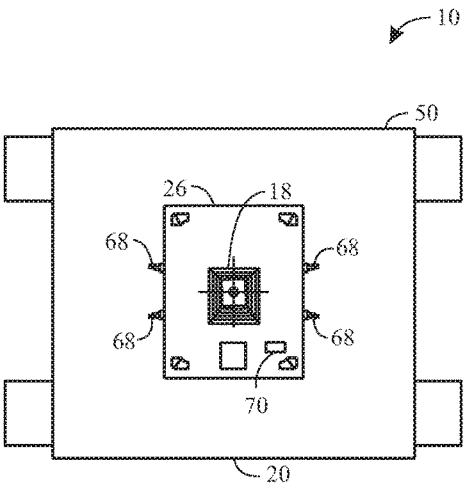
FIG. 8 illustrates a top view of the offshore platform of FIG. 7, in accordance with an embodiment.
Figure 9:
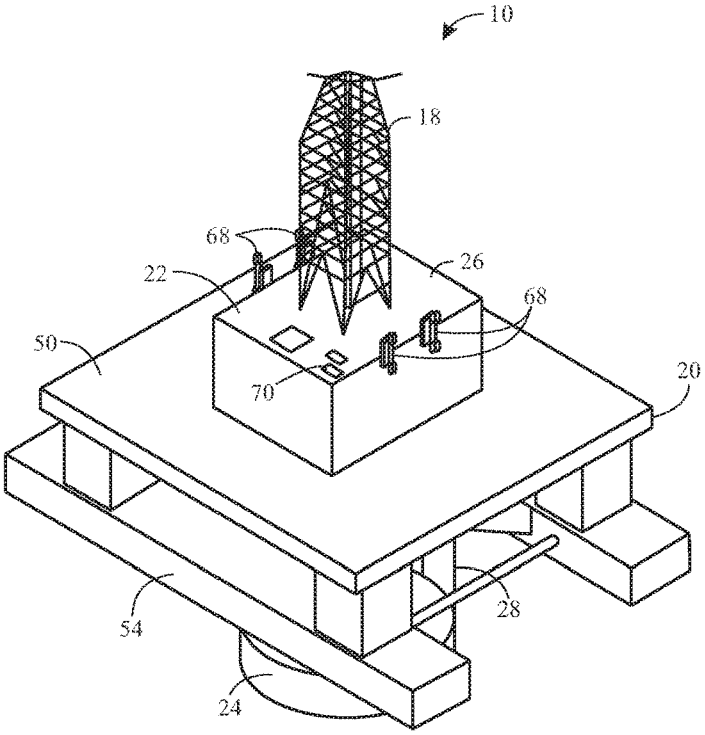
FIG. 9 illustrates an isometric view of the offshore platform of FIG. 7, in accordance with an embodiment.
Figure 10:
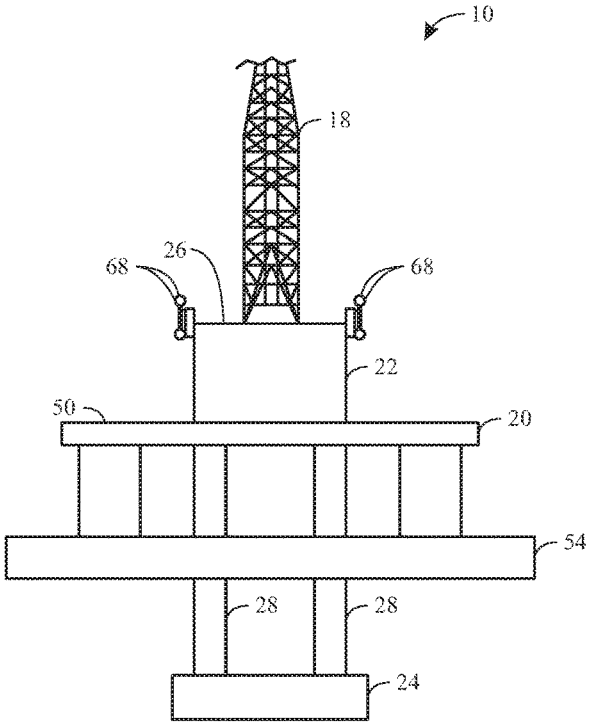
FIG. 10 illustrates a outboard profile view of the offshore platform of FIG. 7, in accordance with an embodiment.
Figure 11:
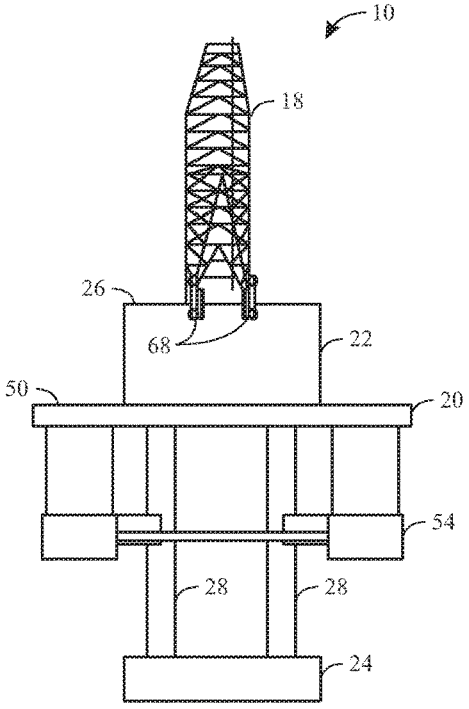
FIG. 11 illustrates a forward profile view of the offshore platform of FIG. 7, in accordance with an embodiment.

FIG. 7 illustrates another embodiment of offshore platform 10 experiencing maritime conditions. It should be noted that the offshore platform 10 of FIG. 7 may operate in conjunction with the buoyant base 24 of FIG. 2, may incorporate the elements of FIGS. 1 and 3, and may operate in a manner analogous to that described above with respect to FIGS. 4-6. Additionally, the offshore platform 10 of FIG. 7 may include one or more tensioners 68. The one or more tensioners 68 may be, for example, part of or illustrative of a riser tensioner system and the one or more tensioners 68 may operate to provide an upward force (in the vertical direction 23 away from the seafloor 14) on the riser 12. This upward force may be independent of movement of the offshore platform 10 (e.g., movement of the stability platform 20 and/or the inner platform 22). The one or more tensioners 68 may dynamically operate to manage differential movements between the riser 12 and the offshore platform 10 to reduce and/or eliminate buckling as well as stretch of the riser 12. In some embodiments, the one or more tensioners 68 may include actuated cylinders (e.g., hydraulically activated cylinders), spring mechanisms, and/or other dampening mechanisms as well as wires and or a pulley system (e.g., one or more sheaves) that may operate in concert to dynamically provide a relatively stable upward force on the riser 12 (e.g., to eliminate or reduce differential movement between the riser 12 and the offshore platform 10). The one or more tensioners 68 may operate to dampen movements between the riser 12 and, for example, the inner platform 22

The one or more tensioners 68 (e.g., a riser tensioner system) may be wholly disposed on the inner platform 22, for example, on the upper plate 26. Likewise, the one or more tensioners 68 (e.g., a riser tensioner system) may be wholly disposed on the stability platform 20. Alternatively, a first portion of the tensioners 68 (e.g., actuated cylinders coupled to a slip joint that may operate as a telescoping joint, a pulley system, and/or a control system for the tensioners 68) may be disposed on the inner platform 22 while a second portion of the tensioners 68 (e.g., the pulley system and/or the control system for the tensioners 68) may be disposed on the stability platform 20.

FIGS. 8, 9, 10, and 11 illustrate a top view, an isometric view, an outboard profile view, and a forward profile view, respectively, of the offshore platform 10 of FIG. 7. As illustrated in each of FIGS. 8-10, four sets of tensioners 68 (each inclusive of a pair of individual tensioners 68 for a total of eight tensioners 68) may be utilized as part of a tensioner riser system. As illustrated, the tensioners 68 may be positioned about the drilling equipment 18 (or any equipment on upper plate 26), such that two sets of the tensioners 68 are disposed on a first common side of the upper plate 26 and two other sets of the tensioners 68 are disposed on a second common side of the upper plate 26. Additionally each of the two sets of tensioners 68 disposed on the first common side of the upper plate 26 are separated from one another by a distance approximately equal to a width of the drilling equipment 18 (or any equipment on upper plate 26). Similarly, each set of the two tensioners 68 disposed on the second common side of the upper plate 26 are likewise separated from one another by a distance approximately equal to a width of the drilling equipment 18 (or any equipment on upper plate 26). By aligning the tensioners 68 as illustrated in each of FIGS. 8-11, independent control of the tensioners 68 (or control of each respective set of tensioners 68 on a side of the upper plate 26) may be undertaken to respond to various environmental conditions to compensate for, for example, one or more linear motions of the offshore platform 10 (e.g., heave) and/or one or more rotational motions of the offshore platform 10 (e.g., pitch). It should be noted that while four sets of pairs of tensioners are illustrated, alternatively, four tensioners 68 (e.g., four individual tensioners 68), sixteen tensioners 68 (e.g., four sets of four tensioners 68), or other configurations of tensioners 68 could be used in place of the illustrated four sets of tensioners 68 in FIGS. 8-10.

Control of the tensioners 68 may be accomplished dynamically through use of a control system 70. The control system 70 may include a sensor and a control monitor, whereby the sensor may be representative of one or more motion detection sensors such as a gyroscope, an accelerometer, or the like and the sensor may measure the motion of the offshore platform 10 and/or the riser 12, for example, in response to environmental factors (e.g., waves and/or currents impacting the offshore platform 10 and/or the riser 12). The sensor may transmit the measured data to a control monitor for use by the control monitor in determining whether to adjust the tension of one or more of the tensioners 68 to regulate the tension on the riser 12.

In some embodiments, the control monitor 70 may be a computing system, such as a general purpose or a special purpose computer. For example, the control monitor 70 may include a processing device, such as one or more application specific integrated circuits (ASICs), one or more processors, or another processing device that interacts with one or more tangible, non-transitory, machine-readable media (e.g., memory) of the control monitor 70 that collectively stores instructions executable by the processing device to perform the methods and actions described herein. By way of example, such machine-readable media can comprise RAM, ROM, EPROM, EEPROM. CD-ROM or other optical disk storage, magnetic disk storage or other magnetic storage devices, or any other medium which can be used to carry or store desired program code in the form of machine-executable instructions or data structures and which can be accessed by the processing device.

Thus, the control monitor 70 may include a processing device that may be operably coupled with the memory to perform various algorithms. In this manner, programs or instructions executed by the processing device may be stored in any suitable article of manufacture that includes one or more tangible, computer-readable media at least collectively storing the instructions or routines, such as the memory. Additionally, the control monitor 70 may include a display that may be a liquid crystal display (LCD) or another type of display that allows users to view images generated by the control monitor 70. The display may include a touch screen, which may allow users to interact with a graphical user interface of the control monitor 70 and the display may be local to (e.g., co-located with) or remotely disposed from the processor and memory.

The control monitor 70 may also include one or more input structures (e.g., one or more of a keypad, mouse, touchpad, one or more switches, buttons, or the like) to allow a user to interact with the control monitor 70, such as to start, control, or operate a GUI or applications running on the control monitor 70. Additionally, the control monitor 70 may include network interface to allow the control monitor 70 to interface with various other electronic devices. The network interface may include a Bluetooth interface, a local area network (LAN) or wireless local area network (WLAN) interface, an Ethernet connection, or the like. The network interface may, for example, receive the measured data from the sensor and the network interface may operate to transmit the received data to the processing device.

The measured data received from the sensor may be utilized by the control monitor 70 to control the tension being applied by one or more of the tensioners 68. Additionally, the control monitor 70 may generate indications of current operating conditions of the tensioners 68, for example, to be displayed on the display to indicate to a user the current tension levels of the tensioners 68, trends related to the adjustments of those tension levels, alarms when the tension levels approach and/or exceed predetermined levels, and the like. The control system 70 may be independent from or a portion of a general control system of the offshore unit 10.

Returning to FIG. 7, a control system 72 is illustrated that may be utilized for the active control of the dynamic movement between the stability platform 20 and the inner platform 22. The control system 72 may include one or more sensors and a control monitor, whereby the sensors may be representative of one or more motion detection sensors, such as a displacement sensor or a proximity sensor, that are able to measure the differential movement between the stability platform 20 and the inner platform 22. The sensors may transmit the measured data to a control monitor for use by the control monitor in determining whether to adjust, for example, the buoyancy of the inner platform 22 (e.g., through control of coverage of the apertures 30 and/or control of the amount of air and/or water in the submerged buoyant base 24) and/or force provided by braking elements 58 (e.g., through control of the respective actuators 60). In this manner, active control of the dynamic movement between the support platform 20 and the inner platform 22 may be controlled.

The control monitor 72 may be a computing system, such as a general purpose or a special purpose computer. For example, the control monitor 72 may include a processing device, such as one or more application specific integrated circuits (ASICs), one or more processors, or another processing device that interacts with one or more tangible, non-transitory, machine-readable media (e.g., memory) of the control monitor 72 that collectively stores instructions executable by the processing device to perform the methods and actions described herein. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processing device.

Thus, the control monitor 70 may include a processing device that may be operably coupled with the memory to perform various algorithms. In this manner, programs or instructions executed by the processing device may be stored in any suitable article of manufacture that includes one or more tangible, computer-readable media at least collectively storing the instructions or routines, such as the memory. Additionally, the control monitor 70 may include a display that may be a liquid crystal display (LCD) or another type of display that allows users to view images generated by the control monitor 70. The display may include a touch screen, which may allow users to interact with a graphical user interface of the control monitor 70 and the display may be local to (e.g., co-located with) or remotely disposed from the processor and memory.

The control monitor 70 may also include one or more input structures (e.g., one or more of a keypad, mouse, touchpad, one or more switches, buttons, or the like) to allow a user to interact with the control monitor 70, such as to start, control, or operate a GUI or applications running on the control monitor 70. Additionally, the control monitor 70 may include network interface to allow the control monitor 70 to interface with various other electronic devices. The network interface may include a Bluetooth interface, a local area network (LAN) or wireless local area network (WLAN) interface, an Ethernet connection, or the like. The network interface may, for example, receive the measured data from the sensor and the network interface may operate to transmit the received data to the processing device.

The measured data received from the sensor may be utilized by the control monitor 72 to control the movements of the stability platform 20 and the inner platform 22 with respect to one another. Additionally, the control monitor 72 may generate indications of current operating conditions of the stability platform 20 and the inner platform 22, for example, to be displayed on the display to indicate to a user the current displacement values between the stability platform 20 and the inner platform 22, trends related to those displacement values, alarms when the displacement levels approach and/or exceed predetermined levels, and the like. Furthermore, the control system 72 may also be utilized in conjunction with the offshore platform 10 of FIG. 1. Likewise, the control system 72 may be independent from or a portion of a general control system of the offshore unit 10 or the control system 70.

The control system 72 may also be utilized when disconnecting the offshore platform 10 from the wellhead 16. For example, the control system 72 may cause the submerged buoyant base 24 to be disconnected from the supports 28 so that a portion of the riser 12 may remain coupled to the submerged buoyant base 24 to allow for expedited reconnection to the riser 12 by the offshore platform 12 at a later time. This may allow the offshore platform 10 to disconnect and reconnect to various risers 12 in a field with greater efficiency. Additionally and/or alternatively, the control system 72 may be utilized in conjunction with the storage operation discussed in FIG. 3 to cause the inner platform 22 to be moved into a storage position, for example, to facilitate movement of the offshore platform 10.

Through the use of a separate stability platform 20 and inner platform 22, the offshore platform 10 may allow for dynamic movement therebetween. This dynamic movement may allow the inner platform 22 to remain at a relatively constant distance from the seafloor 14 while the stability platform 20 moves in response to environmental factors (e.g., the inner platform 22 remains relatively stable in the vertical direction 23 while the stability platform 20 experiences motion, such as heave). Additionally, the stability platform 20 may transmit lateral force to the inner platform 22 to provide restraint in the horizontal direction 25 to the inner platform 22. This use of a separate stability platform 20 and an inner platform 22 can be applied to a semi-submersible platform, a drillship, a spar platform, a floating production system, a jackup rig, or other offshore platforms in which isolating a portion of the offshore platform 10 from certain motions (e.g., heave) is desirable. Additionally, the stability platform 20 can maintain its positioning (e.g., in a horizontal direction 25) and, accordingly, the positioning (e.g., in a horizontal direction 25) of the inner platform 22 through the use of, for example, a dynamic positioning system, moorings, and/or a combination thereof. Likewise, when the offshore platform 10 includes structure supports coupled to the seafloor 14, the seafloor 14 may operate to maintain the positioning (e.g., in a horizontal direction 25) of the stability platform 20 and, accordingly, the positioning (e.g., in a horizontal direction 25) of the inner platform 22.

This written description uses examples to disclose the above description, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiments are to cover all modifications, equivalents, and alternatives falling within the spirit and scope of the embodiments as defined by the following appended claims.

What is claimed is:

1. A system, comprising:

a first platform structure configured to be coupled to a seafloor, wherein the first platform structure comprises an upper portion utilized above a waterline and a lower portion utilized below the waterline when the first platform structure is in operation, wherein the first platform structure comprises a support coupled to the upper portion and the lower portion, wherein the support comprises a covered aperture configured to be exposed to adjustably alter a waterplane area of the first platform structure;

a derrick disposed upon the first platform structure, wherein the lower portion comprises a buoyant base configured to provide an upward force sufficient to support the derrick on the first platform structure and prevent buckling and stretch of a riser of the system that couples the first platform structure to the seafloor; and a second platform structure configured to be coupled to the first platform via a lateral support disposed between the first platform structure and the second platform structure, wherein the second platform structure is configured to provide a lateral force to the first platform structure while allowing for vertical movement between the first platform structure and the second platform structure relative to the seafloor, wherein the second platform structure comprises a second upper portion utilized above the waterline and a second lower portion utilized below the waterline when the second platform structure is in operation, wherein the second upper portion of the second platform structure comprises a deck having an aperture sized to allow the upper portion of the first platform structure to pass through the deck when the first platform structure is in operation.

2. The system of claim 1, wherein the first platform structure is configured to provide a tension force away from the seafloor to the riser of the system that couples the first platform structure to the seafloor.

3. The system of claim 1, comprising a tensioner coupled to the first platform structure and configured to provide a tension force away from the seafloor to the riser of the system that couples the first platform structure to the seafloor.

4. The system of claim 1, wherein the first platform structure comprises an upper plate as the upper portion, wherein the upper plate is configured to support drilling equipment or production equipment inclusive of the derrick.

5. The system of claim 1, wherein the buoyant base is configured to adjustably alter an amount of air, water, or a combination thereof therein to adjust a buoyancy of the first platform structure.

6. The system of claim 1, wherein the first platform structure and the second platform structure form an offshore platform as the system.

7. The system of claim 1, comprising a braking element configured to slow a rate of the vertical movement between the first platform structure and the second platform structure.

8. A system, comprising:

a first platform structure of an offshore platform, wherein the first platform structure comprises an upper portion utilized above a waterline and a lower portion utilized below the waterline when the first platform structure is in operation, wherein the first platform structure comprises a support coupled to the upper portion and the lower portion, wherein the support comprises a covered aperture configured to be exposed to adjustably alter a waterplane area of the first platform structure; wherein the first platform structure is configured to receive a lateral force from a second platform structure of the offshore platform or impart the lateral force to the second platform structure when coupled to the second platform structure, wherein the second platform structure comprises a second upper portion utilized above the waterline and a second lower portion utilized below the waterline when the second platform structure is in operation, wherein the first platform structure is configured to allow for differential movement between the first platform structure and the second platform structure when coupled to the second platform structure, wherein the second upper portion of the second platform structure comprises a deck having an aperture sized to allow the upper portion of the first platform structure to pass through the deck when the first platform structure is in operation;

a first lateral support disposed above the waterline and configured to couple the first platform structure to the second platform structure;

a second lateral support disposed below the waterline and configured to couple the first platform structure to the second platform structure, wherein the first lateral support and the second lateral support are configured to convey the lateral force; and a derrick disposed on the first platform structure, wherein the lower portion comprises a buoyant base configured to provide an upward force sufficient to support the derrick on the first platform structure and prevent buckling and stretch of a riser of the system that couples the first platform structure to a seafloor.

9. The system of claim 8, wherein the second platform structure is configured to allow for vertical movement relative to the seafloor as the differential movement.

10. The system of claim 8, comprising a fastener to couple the first platform structure to the second platform structure.

11. The system of claim 8, comprising a braking element configured to slow a rate of the differential movement between the first platform structure and the second platform structure.

12. The system of claim 8, wherein the second platform structure is configured to circumscribe the first platform structure.

13. The system of claim 8, comprising a post configured to cushion the differential movement between first platform structure and the second platform structure.

* * * * *